US012808011B2

(12) United States Patent
Ito et al.

(10) Patent No.: US 12,808,011 B2
(45) **Date of Patent: *Nov. 24, 2026**

(54) STEEL SHEET AND PRESS-FORMED ARTICLE

(71) Applicant: NIPPON STEEL CORPORATION, Tokyo (JP)

(72) Inventors: Yasuhiro Ito, Tokyo (JP); Mai Nagano, Tokyo (JP); Hiroyuki Kawata, Tokyo (JP); Satoshi Hironaka, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 379 days.

This patent is subject to a terminal disclaimer.

(21) Appl. No.: 18/681,807

(22) PCT Filed: Aug. 27, 2021

(86) PCT No.: PCT/JP2021/031492

§ 371 (c)(1),
(2) Date: Feb. 6, 2024

(87) PCT Pub. No.: WO2023/026468

PCT Pub. Date: Mar. 2, 2023

(65) Prior Publication Data

US 2024/0344165 A1 Oct. 17, 2024

(51) Int. Cl.

| | |
|---|---|
| ***C21D 9/46*** | (2006.01) |
| ***C21D 8/02*** | (2026.01) |
| ***C21D 8/0221*** | (2026.01) |
| ***C21D 8/0247*** | (2026.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C23C 2/06*** | (2006.01) |
| ***C23C 2/40*** | (2006.01) |

(52) U.S. Cl.

CPC ..... *C21D 9/46* (2013.01); *C21D 8/0226* (2013.01); *C21D 8/0236* (2013.01); *C21D 8/0273* (2013.01); *C22C 38/001* (2013.01); *C22C 38/002* (2013.01); *C22C 38/02* (2013.01); *C22C 38/04* (2013.01); *C22C 38/06* (2013.01); *C23C 2/06* (2013.01); *C23C 2/40* (2013.01)

(58) Field of Classification Search

CPC ... C22C 38/001; C22C 38/002; C22C 38/005; C22C 38/008; C22C 38/02; C22C 38/04; C22C 38/06; C22C 38/12; C22C 38/14; C22C 38/22; C22C 38/28; C22C 38/32; C22C 38/38; C22C 38/44; C22C 38/58; C22C 38/60; C22C 38/42; C22C 38/46; C22C 38/48; C22C 38/50; C22C 38/54; C21D 1/18; C21D 1/673; C21D 1/76; C21D 8/0226; C21D 8/0236; C21D 8/0257; C21D 8/0263; C21D 8/0273; C21D 9/46; C23C 2/06; C23C 2/40

See application file for complete search history.

(56) References Cited

U.S. PATENT DOCUMENTS

| | | | | |
|---|---|---|---|---|
| 12,522,907 | B2 * | 1/2026 | Nishimura | B62D 25/105 |
| 2004/0238081 | A1 * | 12/2004 | Yoshinaga | C22C 38/06 148/320 |
| 2006/0191612 | A1 * | 8/2006 | Yoshida | C22C 38/12 148/603 |
| 2014/0234657 | A1 | 8/2014 | Azuma et al. | |
| 2015/0209848 | A1 | 7/2015 | Kopplin et al. | |
| 2017/0029915 | A1 | 2/2017 | Hayashi | |
| 2018/0105908 | A1 * | 4/2018 | Hayashi | C21D 8/0257 |

FOREIGN PATENT DOCUMENTS

| | | | |
|---|---|---|---|
| CN | 103586353 | A | 2/2014 |
| CN | 106964722 | A | 7/2017 |
| JP | 2-30306 | A | 1/1990 |
| JP | 2003-105512 | A | 4/2003 |
| JP | 2005-220430 | A | 8/2005 |
| JP | 2006-104546 | A | 4/2006 |
| JP | 2017-2333 | A | 1/2017 |

(Continued)

OTHER PUBLICATIONS

U.S. Notice of Allowance for U.S. Appl. No. 18/579,354, dated Sep. 30, 2025.

(Continued)

*Primary Examiner* — Anthony M Liang

(74) *Attorney, Agent, or Firm* — Birch, Stewart, Kolasch & Birch, LLP

(57) ABSTRACT

Adopted are a steel sheet contains, as a chemical composition, by mass %, C: 0.040% to 0.105%, Mn: 1.00% to 2.30%, Si: 0.005% to 1.500%, Al: 0.005% to 0.700%, P: 0.100% or less, S: 0.0200% or less, N: 0.0150% or less, O: 0.0100% or less, and a remainder: Fe and impurities, in which ΔC that is calculated from $C_{20}$, which is a C content at a 20 μm depth position from a surface, $C_{60}$, which is a C content at a 60 μm depth position from the surface, and the following expression (1) is in a range of 0.20 to 0.90 mass %/mm, and a press-formed article that is obtained by press-forming the steel sheet.

$$\Delta C = (C_{60} - C_{20})/(0.04) \quad (1)$$

8 Claims, No Drawings

(56) References Cited

FOREIGN PATENT DOCUMENTS

| | | | |
|---|---|---|---|
| JP | 2017-48412 | A | 3/2017 |
| WO | WO 98/55246 | A1 | 12/1998 |
| WO | WO 2013/047820 | A1 | 4/2013 |
| WO | WO 2015/097882 | A1 | 7/2015 |
| WO | WO 2016/121388 | A1 | 8/2016 |

OTHER PUBLICATIONS

U.S. Office Action for U.S. Appl. No. 18/579,354, dated Apr. 3, 2025.
U.S. Office Action for U.S. Appl. No. 18/579,354, dated Jun. 17, 2025.

* cited by examiner

STEEL SHEET AND PRESS-FORMED ARTICLE

TECHNICAL FIELD OF THE INVENTION

The present invention relates to a steel sheet and a press-formed article.

BACKGROUND ART

From the viewpoint of protecting the global environment, a vehicle body is required to be lighter and have improved collision safety. In order to meet these demands, also with respect to panel system components such as a door outer, high-strengthening and thinning are being studied. Unlike a frame component, these panel system components are required to have high external appearance quality due to public exposure. Therefore, in the related art, even a high-strength steel sheet that has been applied to a frame component is required to have excellent external appearance quality after forming in a case where it is applied to a panel system component.

In order to improve external appearance quality, one object is to suppress the occurrence of ghost lines. The ghost lines are fine irregularities on the order of several millimeters, which occur on a surface because, when a steel sheet having a hard phase and a soft phase is press-formed, a periphery of the soft phase is preferentially deformed. Since the irregularities form stripe patterns on the surface, a press-formed article with the ghost lines is inferior in external appearance quality.

For example, Patent Document 1 discloses a high-strength hot-dip galvanized steel sheet having excellent surface quality. Specifically, Patent Document 1 discloses a high-strength hot-dip galvanized steel sheet that includes a steel sheet (substrate) which contains, by mass %, C: 0.02% to 0.20%, Si: 0.7% or less, Mn: 1.5% to 3.5%, P: 0.10% or less, S: 0.01% or less, Al: 0.1% to 1.0%, N: 0.010% or less, and Cr: 0.03% to 0.5%, and in which a surface oxidation index A during annealing defined by an expression A=400Al/(4Cr+3Si+6Mn) with the contents of Al, Cr, Si, and Mn as the same item is 2.3 or more, a remainder consists of Fe and unavoidable impurities, a structure of the substrate consists of ferrite and a secondary phase, and the secondary phase is predominantly martensite, and that has a hot-dip galvanized layer on a surface of the substrate.

Patent Document 2 discloses a high-strength cold-rolled steel sheet and a high-strength plated steel sheet, in which tensile strength of a surface layer area is 780 MPa or more and formability is good, and a method for manufacturing these steel sheets.

Patent Document 3 discloses a high-strength member for a vehicle and a hot pressing method for the member, in which in a method for forming a high-strength member for a vehicle with hot pressing, hydrogen embrittlement susceptibility due to post-processing after the hot pressing can be secured without dehydrogenation treatment.

Patent Document 4 discloses a hot-dip galvanized steel sheet having a tensile strength (TS) of 980 MPa or more and having excellent plating adhesion and delayed fracture resistance property, and a method for manufacturing the steel sheet.

Patent Document 5 discloses a hot-pressed steel sheet member in which excellent collision characteristics can be obtained while having high strength, a method for manufacturing the steel sheet member, and a steel sheet for hot pressing.

Patent Document 6 discloses a hot-dip galvanized steel sheet and a hot-dip galvannealed steel sheet having good elongation characteristic and bendability, and a methods for manufacturing these steel sheets.

PRIOR ART DOCUMENT

Patent Document

[Patent Document 1] Japanese Unexamined Patent Application, First Publication No. 2005-220430

[Patent Document 2] PCT International Publication No. WO2016/121388

[Patent Document 3] Japanese Unexamined Patent Application, First Publication No. 2006-104546

[Patent Document 4] PCT International Publication No. WO2013/047820

[Patent Document 5] PCT International Publication No. WO2015/097882

[Patent Document 6] Japanese Unexamined Patent Application, First Publication No. 2017-48412

DISCLOSURE OF THE INVENTION

Problems to be Solved by the Invention

The present invention has been made in view of the above circumstances. An object of the present invention is to provide a press-formed article having high strength (specifically, tensile strength: 500 MPa or more) and excellent external appearance quality, and a steel sheet which can manufacture of the press-formed article.

Means for Solving the Problem

The gist of the present invention is as follows.

(1) A steel sheet according to one aspect of the present invention consisting of, as a chemical composition, by mass %:

C: 0.040% to 0.105%,
Mn: 1.00% to 2.30%,
Si: 0.005% to 1.500%,
Al: 0.005% to 0.700%,
P: 0.100% or less,
S: 0.0200% or less,
N: 0.0150% or less,
O: 0.0100% or less,
Cr: 0% to 0.80%,
Mo: 0% to 0.16%,
Ti: 0% to 0.100%,
B: 0% to 0.0100%,
Nb: 0% to 0.060%,
V: 0% to 0.50%,
Ni: 0% to 1.00%,
Cu: 0% to 1.00%,
W: 0% to 1.00%,
Sn: 0% to 1.00%,
Sb: 0% to 0.200%,
Ca: 0% to 0.0100%,
Mg: 0% to 0.0100%,
Zr: 0% to 0.0100%,
REM: 0% to 0.0100%, and
a remainder: Fe and impurities, in which ΔC that is calculated from $C_{20}$, which is a C content at a 20 μm depth position from a surface, $C_{60}$, which is a C content at a 60 μm depth position from the surface, and the following expression (1) is in a range of 0.20 to 0.90 mass %/mm.

$$\Delta C = (C_{60} - C_{20})/(0.04) \quad (1)$$

(2) The steel sheet according to the above (1) may further include, as the chemical composition, by mass %, one or two or more selected from the group consisting of:

Cr: 0.01% to 0.80%,
Mo: 0.01% to 0.16%,
Ti: 0.001% to 0.100%,
B: 0.0001% to 0.0100%,
Nb: 0.001% to 0.060%,
V: 0.01% to 0.50%,
Ni: 0.01% to 1.00%,
Cu: 0.01% to 1.00%,
W: 0.01% to 1.00%,
Sn: 0.01% to 1.00%,
Sb: 0.001% to 0.200%,
Ca: 0.0001% to 0.0100%,
Mg: 0.0001% to 0.0100%,
Zr: 0.0001% to 0.0100%, and
REM: 0.0001% to 0.0100%.

(3) The steel sheet according to the above (1) or (2) may further include, as the chemical composition, by mass %, C: 0.040% to 0.080%.

(4) In the steel sheet according to any one of the above (1) to (3), the ΔC may be in a range of 0.30 to 0.80 mass %/mm.

(5) In the steel sheet according to any one of the above (1) to (4), at least one surface of the steel sheet may have a plating layer.

(6) In the steel sheet according to any one of the above (1) to (5), tensile strength may be in a range of 500 to 750 MPa.

(7) A press-formed article according to another aspect of the present invention is a press-formed article that is obtained by press-forming the steel sheet according to any one of the above (1) to (6), in which ΔC that is calculated from $C_{20}$, which is a C content at a 20 μm depth position from a surface, $C_{60}$, which is a C content at a 60 μm depth position from the surface, and the following expression (1) is in a range of 0.20 to 0.90 mass %/mm.

$$\Delta C = (C_{60} - C_{20})/(0.04) \quad (1)$$

Effects of the Invention

According to the above aspects of the present invention, it is possible to provide a press-formed article having high strength and excellent external appearance quality, and a steel sheet which can manufacture of the press-formed article.

Having excellent external appearance quality means that the occurrence of ghost lines is suppressed.

EMBODIMENTS OF THE INVENTION

The inventors of the present invention have studied a method for suppressing the occurrence of ghost lines when press-forming a high-strength steel sheet. As a result, the inventors of the present invention have found that it is effective to reduce a hardness difference in steel. The inventors of the present invention have found that a hardness difference in steel can be reduced by forming a uniform decarburized layer with a small hardness difference by decarburizing a surface layer of a steel sheet.

When decarburization annealing is performed on a steel sheet, a C content is reduced from a region close to a surface and a decarburized layer is formed. The stronger the decarburization conditions, the more the thickness of the decarburized layer increases. C concentration in the decarburized layer increases from a region close to the surface of the steel sheet toward a base metal side (inside the steel sheet). However, an upper limit thereof is the C content of the base metal. That is, a C concentration gradient from the surface to the inside of the steel sheet depends on the decarburization conditions and the C content of the steel sheet.

Since a region with low C concentration easily becomes a ferrite single phase, the surface of the steel sheet is softened with respect to the inside of the steel sheet. In the decarburized layer, when the C concentration sharply increases toward the inside of the steel sheet, a hardness difference increases, so that it is considered that ghost lines occur after press forming. The inventors of the present invention have found that by setting the C concentration gradient in the decarburized layer within a desired range, the hardness difference in the decarburized layer can be reduced, and that the occurrence of ghost lines after press forming can be suppressed.

The present invention has been made based on the above knowledge, and a steel sheet and a press-formed article according to the present embodiment will be described in detail below. However, the present invention is not limited to configurations disclosed in the present embodiment, and various modifications can be made without departing from the gist of the present invention.

First, a chemical composition of the steel sheet according to the present embodiment will be described. The numerical limit range described below with "to" in between includes the lower limit and the upper limit. Numerical values indicated as "less than" or "exceed" do not fall within the numerical range. In the following description, % regarding the chemical composition is mass % unless otherwise specified.

A steel sheet according to an aspect of the present embodiment contains, as a chemical composition, by mass %, C: 0.040% to 0.105%, Mn: 1.00% to 2.30%, Si: 0.005% to 1.500%, Al: 0.005% to 0.700%, P: 0.100% or less, S: 0.0200% or less, N: 0.0150% or less, O: 0.0100% or less, and a remainder: Fe and impurities. Each element will be described below.

C: 0.040% to 0.105%

C is an element that increases the strength of the steel sheet and a press-formed article. In order to obtain a desired strength, the C content is set to 0.040% or more. In order to further increase the strength of the steel sheet, the C content is preferably 0.050% or more and more preferably 0.060% or more or 0.070% or more.

Further, by setting the C content to 0.105% or less, the occurrence of an excessive hardness difference in a decarburized layer can be suppressed. As a result, the occurrence of ghost lines after press forming can be suppressed. Therefore, the C content is set to 0.105% or less. The C content is preferably 0.090% or less and more preferably 0.080% or less.

Mn: 1.00% to 2.30%

Mn is an element that enhances the hardenability of steel and contributes to improvement in strength. In order to obtain a desired strength, the Mn content is set to 1.00% or more. The Mn content is preferably 1.05% or more or 1.10% or more and more preferably 1.20% or more, 1.30% or more, or 1.40% or more.

Further, by setting the Mn content to 2.30% or less, easy occurrence of the hardness difference in steel can be suppressed. Therefore, the Mn content is set to 2.30% or less. The Mn content is preferably 2.10% or less or 2.00% or less and more preferably 1.90% or less, 1.80% or less, or 1.70% or less.

Si: 0.005% to 1.500%

Si is an element that forms a coarse Si oxide that acts as a starting point for destruction. By setting the Si content to 1.500% or less, the formation of a Si oxide can be suppressed, and cracking does not easily occur. As a result, embrittlement of steel can be suppressed. Therefore, the Si content is set to 1.500% or less. The Si content is preferably 1.300% or less or 1.000% or less and more preferably 0.800% or less, 0.600% or less, or 0.500% or less.

The Si content is set to 0.005% or more in order to improve the strength-formability balance of the steel sheet. The Si content is preferably 0.010% or more or 0.020% or more.

Al: 0.005% to 0.700%

Al is an element that functions as a deoxidizing material. Further, Al is also an element that forms a coarse oxide that serves as a starting point for destruction and that makes steel brittle. By setting the Al content to 0.700% or less, it is possible to suppress the formation of a coarse oxide that acts as a starting point for destruction, and to suppress a cast piece from being easily cracked. Therefore, the Al content is set to 0.700% or less. The Al content is preferably 0.650% or less, 0.400% or less, or 0.200% or less and more preferably 0.100% or less, 0.080% or less, or 0.060% or less.

The Al content is set to 0.005% or more in order to sufficiently obtain the deoxidizing effect of Al. The Al content is preferably 0.010% or more, 0.020% or more, 0.030% or more, or 0.040% or more.

P: 0.100% or less

P is an element that is mixed in as an impurity, and is also an element that makes steel brittle. When the P content is 0.100% or less, the steel sheet can be suppressed from becoming brittle and being easily cracked during a production process. Therefore, the P content is set to 0.100% or less. From the viewpoint of productivity, the P content is preferably 0.050% or less and more preferably 0.030% or less or 0.020% or less.

Although a lower limit of the P content includes 0%, a manufacturing cost can be further reduced by setting the P content to 0.001% or more. Therefore, the P content may be set to 0.001% or more.

S: 0.0200% or less

S is an element that is mixed in as an impurity, and is also an element that forms a Mn sulfide and deteriorates formability such as ductility, hole expansibility, stretch flangeability, and bendability of the steel sheet. When the S content is 0.0200% or less, a significant decrease in formability of the steel sheet can be suppressed. Therefore, the S content is set to 0.0200% or less. The S content is preferably 0.0100% or less or 0.0080% or less and more preferably 0.0060% or less or 0.0040% or less.

Although a lower limit of the S content includes 0%, a manufacturing cost can be further reduced by setting the S content to 0.0001% or more. Therefore, the S content may be set to 0.0001% or more.

N: 0.0150% or less

N is an element that is mixed in as an impurity, and is also an element that forms a nitride and deteriorates the formability such as ductility, hole expansibility, stretch flangeability, and bendability of the steel sheet. When the N content is 0.0150% or less, a decrease in formability of the steel sheet can be suppressed. Therefore, the N content is set to 0.0150% or less. Further, N is also an element that causes weld defects during welding and hinders productivity. Therefore, the N content is preferably 0.0120% or less or 0.0100% or less and more preferably 0.0080% or less or 0.0060% or less.

Although a lower limit of the N content includes 0%, a manufacturing cost can be further reduced by setting the N content to 0.0005% or more. Therefore, the N content may be set to 0.0005% or more.

O: 0.0100% or less

O is an element that is mixed in as an impurity, and is also an element that forms an oxide and hinders the formability such as ductility, hole expansibility, stretch flangeability, and bendability of the steel sheet. When the O content is 0.0100% or less, a significant decrease in formability of the steel sheet can be suppressed. Therefore, the O content is set to 0.0100% or less. The O content is preferably 0.0080% or less or 0.0050% or less and more preferably 0.0030% or less or 0.0020% or less.

Although a lower limit of the O content includes 0%, a manufacturing cost can be further reduced by setting the O content to 0.0001% or more. Therefore, the O content may be set to 0.0001% or more.

The steel sheet according to the present embodiment may contain the following elements as optional elements, instead of a part of Fe. The contents of the following optional elements are 0% in a case where the following optional elements are not contained.

Cr: 0% to 0.80%

Cr is an element that increases the hardenability of steel and contributes to improvement in strength of the steel sheet. Since Cr does not need to be contained, a lower limit of the Cr content includes 0%. In order to sufficiently obtain a strength improvement effect of Cr, the Cr content is preferably 0.01% or more or 0.20% or more and more preferably 0.30% or more.

Further, when the Cr content is 0.80% or less, the formation of a coarse Cr carbide that may act as a starting point for destruction can be suppressed. Therefore, the Cr content is set to 0.80% or less. In order to reduce alloy costs, the Cr content is set to preferably 0.60% or less or 0.40% or less and more preferably 0.20% or less, 0.10% or less, or 0.06% or less.

Mo: 0% to 0.16%

Mo is an element that suppresses phase transformation at a high temperature and contributes to improvement in strength of the steel sheet. Since Mo does not need to be contained, a lower limit of the Mo content includes 0%. In order to sufficiently obtain a strength improvement effect of Mo, the Mo content is preferably 0.01% or more or 0.05% or more and more preferably 0.10% or more.

Further, when the Mo content is 0.16% or less, a decrease in hot workability and a decrease in productivity can be suppressed. Therefore, the Mo content is set to 0.16% or less. In order to reduce alloy costs, the Mo content is set to preferably 0.12% or less or 0.08% or less and more preferably 0.06% or less, 0.04% or less, or 0.02% or less.

Ti: 0% to 0.100%

Ti is an element that has the effect of reducing the amounts of S, N, and O that generate coarse inclusions that act as starting points for destruction. Further, Ti has the effect of refining the structure and improving the strength-formability balance of the steel sheet. Since Ti does not need to be contained, a lower limit of the Ti content includes 0%. In order to sufficiently obtain the above effects, the Ti content is set to preferably 0.001% or more and more preferably 0.010% or more.

Further, when the Ti content is 0.100% or less, the formation of coarse Ti sulfides, Ti nitrides, and Ti oxides can be suppressed, and the formability of the steel sheet can be secured. Therefore, the Ti content is set to 0.100% or less. The Ti content is set to preferably 0.075% or less or 0.060% or less and more preferably 0.040% or less or 0.020% or less.

B: 0% to 0.0100%

B is an element that suppresses phase transformation at a high temperature and contributes to improvement in strength of the steel sheet. Since B does not need to be contained, a lower limit of the B content includes 0%. In order to sufficiently obtain a strength improvement effect of B, the B content is preferably 0.0001% or more or 0.0005% or more and more preferably 0.0010% or more.

Further, when the B content is 0.0100% or less, a decrease in strength of the steel sheet due to creation of B precipitates can be suppressed. Therefore, the B content is set to 0.0100% or less. In order to reduce alloy costs, the B content is set to preferably 0.0080% or less, 0.0060% or less and more preferably 0.0040% or less, 0.0030% or less, or 0.0015% or less.

Nb: 0% to 0.060%

Nb is an element that contributes to improvement in strength of the steel sheet through strengthening by precipitates, grain refinement strengthening by growth suppression of ferrite grains, and dislocation strengthening by suppression of recrystallization. Since Nb does not need to be contained, a lower limit of the Nb content includes 0%. In order to sufficiently obtain the above effect, the Nb content is set to preferably 0.001% or more or 0.005% or more and more preferably 0.010% or more.

Further, when the Nb content is 0.060% or less, recrystallization can be promoted, remaining of non-recrystallized ferrite can be suppressed, and the formability of the steel sheet can be secured. Therefore, the Nb content is set to 0.060% or less. The Nb content is preferably 0.050% or less and more preferably 0.040% or less, 0.030% or less, or 0.015% or less.

V: 0% to 0.50%

V is an element that contributes to improvement in strength of the steel sheet through strengthening by precipitates, grain refinement strengthening by growth suppression of ferrite grains, and dislocation strengthening by suppression of recrystallization. Since V does not need to be contained, a lower limit of the V content includes 0%. In order to sufficiently obtain a strength improvement effect of V, the V content is preferably 0.01% or more, and more preferably 0.03% or more.

Further, when the V content is 0.50% or less, a decrease in formability of the steel sheet due to precipitation of a large amount of carbonitrides can be suppressed. Therefore, the V content is set to be 0.50% or less. In order to reduce alloy costs, the V content is set to preferably 0.30% or less or 0.10% or less and more preferably 0.08% or less, 0.06% or less, or 0.03% or less.

Ni: 0% to 1.00%

Ni is an element that suppresses phase transformation at a high temperature and contributes to improvement in strength of the steel sheet. Since Ni does not need to be contained, a lower limit of the Ni content includes 0%. In order to sufficiently obtain a strength improvement effect of Ni, the Ni content is preferably 0.01% or more or 0.05% or more, and more preferably 0.20% or more.

Further, when the Ni content is 1.00% or less, a decrease in the weldability of the steel sheet can be suppressed. Therefore, the Ni content is set to 1.00% or less. In order to reduce alloy costs, the Ni content is set to preferably 0.70% or less or 0.50% or less and more preferably 0.30% or less, 0.15% or less, or 0.08% or less.

Cu: 0% to 1.00%

Cu is an element that exists in steel in the form of fine particle and contributes to improvement in strength of the steel sheet. Sine Cu does not need to be contained, a lower limit of the Cu content includes 0%. In order to sufficiently obtain a strength improvement effect of Cu, the Cu content is preferably 0.01% or more or 0.05% or more, and more preferably 0.15% or more.

Further, when the Cu content is 1.00% or less, a decrease in the weldability of the steel sheet can be suppressed. Therefore, the Cu content is set to 1.00% or less. In order to reduce alloy costs, the Cu content is set to preferably 0.70% or less or 0.50% or less, and more preferably 0.30% or less, 0.15% or less, or 0.08% or less.

W: 0% to 1.00%

W is an element that suppresses phase transformation at a high temperature and contributes to improvement in strength of the steel sheet. Since W does not need to be contained, a lower limit of the W content includes 0%. In order to sufficiently obtain a strength improvement effect of W, the W content is preferably 0.01% or more or 0.03% or more, and more preferably 0.10% or more.

Further, when the W content is 1.00% or less, a decrease in hot workability and a decrease in productivity can be suppressed. Therefore, the W content is set to 1.00% or less. In order to reduce alloy costs, the W content is set to preferably 0.70% or less or 0.50% or less and more preferably 0.30% or less, 0.15% or less, or 0.08% or less.

Sn: 0% to 1.00%

Sn is an element that suppresses coarsening of crystal grains and contributes to improvement in strength of the steel sheet. Since Sn does not need to be contained, a lower limit of the Sn content includes 0%. In order to sufficiently obtain an effect of Sn, the Sn content is more preferably 0.01% or more.

Further, when the Sn content is 1.00% or less, embrittlement of the steel sheet and breakage during rolling can be suppressed. Therefore, the Sn content is set to 1.00% or less. In order to reduce alloy costs, the Sn content is set to preferably 0.70% or less or 0.50% or less and more preferably 0.30% or less, 0.15% or less, or 0.08% or less.

Sb: 0% to 0.200%

Sb is an element that suppresses coarsening of crystal grains and contributes to improvement in strength of the steel sheet. Since Sb does not need to be contained, a lower limit of the Sb content includes 0%. In order to sufficiently obtain the above effect, the Sb content is preferably 0.001% or more, or 0.005% or more.

Further, when the Sb content is 0.200% or less, embrittlement of the steel sheet and breakage during rolling can be suppressed. Therefore, the Sb content is set to 0.200% or less. In order to reduce alloy costs, the Sb content is set to preferably 0.100% or less or 0.050% or less and more preferably 0.030% or less, 0.010% or less, or 0.005% or less.

Ca: 0% to 0.0100%

Mg: 0% to 0.0100%

Zr: 0% to 0.0100%

REM: 0% to 0.0100%

Ca, Mg, Zr, and REM are elements that contribute to improvement in formability of the steel sheet. Since Ca, Mg, Zr, and REM do not need to be contained, a lower limit of the content of each of these elements includes 0%. In order to sufficiently obtain the effect of improving formability, the content of each of these elements is preferably 0.0001% or more, and more preferably 0.0010% or more.

Further, when the content of each of Ca, Mg, Zr, and REM is 0.0100% or less, a decrease in ductility of the steel sheet can be suppressed. Therefore, the content of each of these elements is set to 0.0100% or less. Preferably, the content of each of these elements is 0.0050% or less or 0.0030% or less.

Rare Earth Metal (REM) means a group of elements belonging to the lanthanide series.

The remainder of the chemical composition of the steel sheet according to the present embodiment may be Fe and impurities. As the impurities, impurities that are unavoidably mixed in from a steel raw material or scraps and/or during a steelmaking process, or elements that are allowed within a range that does not impair the properties of the steel sheet according to the present embodiment are exemplary examples. As examples of the impurities, H, Na, Cl, Co, Zn, Ga, Ge, As, Se, Y, Tc, Ru, Rh, Pd, Ag, Cd, In, Te, Cs, Ta, Re, Os, Ir, Pt, Au, Pb, Bi, and Po can be given. The total content of the impurities may be 0.100% or less.

The chemical composition of the steel sheet described above may be measured by a general analysis method. For example, the chemical composition may be measured using Inductively Coupled Plasma-Atomic Emission Spectrometry (ICP-AES). C and S may be measured using a combustion-infrared absorption method, N may be measured using an inert gas fusion-thermal conductivity method, and O may be measured using an inert gas fusion-nondispersive infrared absorption method.

In a case where the steel sheet has a plating layer on the surface thereof, the chemical composition may be analyzed after the plating layer on the surface is removed by mechanical grinding.

ΔC that is calculated from $C_{20}$, which is a C content at a 20 μm depth position from a surface, $C_{60}$, which is a C content at a 60 μm depth position from the surface, and the following expression (1) is in a range of 0.20 to 0.90 mass %/mm.

$$\Delta C = (C_{60} - C_{20})/(0.04) \quad (1)$$

ΔC indicates a C concentration gradient in a region from a 20 μm depth position from a surface to a 60 μm depth position from the surface in a decarburized layer formed on a surface layer. A sharp increase in the C concentration gradient in the decarburized layer can be suppressed by setting ΔC to be in a range of 0.20 to 0.90 mass %/mm. As a result, it is possible to suppress the occurrence of ghost lines after press forming.

In the steel sheet having the chemical composition of the present embodiment, ΔC being less than 0.20 mass %/mm means that decarburization does not sufficiently occur, or decarburization excessively proceeds to a very deep position from the surface of the steel sheet. In a case where decarburization does not sufficiently occur, the influence of dispersion in the hardness of base metal becomes significant, making it difficult to suppress the occurrence of ghost lines. On the other hand, in a case where excessive decarburization occurs, softening progresses, so that there is a case where a desired steel sheet strength is not obtained. Therefore, ΔC is set to 0.20 mass %/mm or more. Further, when ΔC exceeds 0.90 mass %/mm, a hardness difference in the decarburized layer becomes significant, making it difficult to suppress the occurrence of ghost lines. ΔC is set to preferably 0.30 mass %/mm or more, 0.35 mass %/mm or more, 0.40 mass %/mm or more, or 0.45 mass %/mm or more. Further, ΔC is set to preferably 0.80 mass %/mm or less or 0.75 mass %/mm or less.

In a case where the steel sheet has a plating layer on the surface thereof, the "surface" at a "20 μm depth position from the surface" and a "region at 60 μm depth position from the surface" is an interface between the plating layer and the base metal. When the Fe content is measured from the surface by GDS analysis by using a method which will be described later, a depth position where the Fe content is 95 mass % or more is regarded as the interface between the plating layer and the base metal.

Further, the reason why ΔC at a depth position of 20 μm or more from the surface is specified is that the C concentration at a depth of less than 20 μm from the surface does not affect ghost lines.

ΔC is obtained by the following method.

With respect to three optional locations of the steel sheet, the C content (mass %) from the surface of the steel sheet to 100 μm in a depth direction (a sheet thickness direction) is measured by glow discharge optical emission spectrometry (GDS analysis). ΔC (mass %/mm) is calculated from the C content ($C_{20}$) at a 20 μm depth position from the surface, the C content ($C_{60}$) at a 60 μm depth position from the surface, and the expression (1) described above. ΔC is obtained by calculating an average value of ΔC at three locations.

For the measurement, a Marcus type high-frequency glow discharge luminescence surface analyzer (GD-Profiler) manufactured by Horiba Ltd., is used.

The steel sheet according to the present embodiment may have a plating layer on at least one surface of the steel sheet. As the plating layer, a galvanized layer, a zinc alloy plating layer, and an alloyed galvanized layer and an alloyed zinc alloy plating layer obtained by performing alloying treatment on the above layers can be given.

The galvanized layer and the zinc alloy plating layer are formed by a hot-dip plating method, an electroplating method, or a vapor deposition plating method. When the Al content of the galvanized layer is 0.5% by mass or less, the adhesion between the surface of the steel sheet and the galvanized layer can be sufficiently secured. Therefore, the Al content of the galvanized layer is preferably 0.5% by mass or less.

In a case where the galvanized layer is a hot-dip galvanized layer, the Fe content of the hot-dip galvanized layer is preferably 3.0% by mass or less in order to increase the adhesion between the steel sheet surface and the galvanized layer.

In a case where the galvanized layer is an electrogalvanized layer, the Fe content of the electrogalvanized layer is preferably 0.5% by mass or less from the viewpoint of improving corrosion resistance.

The galvanized layer and the zinc alloy plating layer may contain one or two or more of Al, Ag, B, Be, Bi, Ca, Cd, Co, Cr, Cs, Cu, Ge, Hf, Zr, I, K, La, Li, Mg, Mn, Mo, Na, Nb, Ni, Pb, Rb, Sb, Si, Sn, Sr, Ta, Ti, V, W, Zr, and REM, in a range that does not impair the corrosion resistance and formability of the steel sheet. In particular, Ni, Al, and Mg are effective in improving the corrosion resistance of the steel sheets.

The galvanized layer or the zinc alloy plating layer may be an alloyed galvanized layer or an alloyed zinc alloy plating layer subjected to alloying treatment. In a case where alloying treatment is performed on the hot-dip galvanized layer or the hot-dip zinc alloy plating layer, from the viewpoint of improving the adhesion between the steel sheet surface and the alloyed plating layer, the Fe content of the hot-dip galvanized layer after the alloying treatment (the alloyed galvanized layer) or the hot-dip zinc alloy plating layer (the alloyed zinc alloy plating layer) is preferably in a range of 7.0 to 13.0% by mass. By performing alloying treatment on the steel sheet having a hot-dip galvanized layer or a hot-dip zinc alloy plating layer, Fe is taken into the plating layer and the Fe content is increased. In this way, it is possible to set the Fe content to 7.0% by mass or more. That is, the galvanized layer having the Fe content of 7.0% by mass or more is an alloyed galvanized layer or an alloyed zinc alloy plating layer.

The Fe content in the plating layer can be obtained by the following method. Only the plating layer is dissolved and removed by using a 5% by volume HCl aqueous solution with an inhibitor added thereto. The Fe content (mass %) in the plating layer is obtained by measuring the Fe content in the obtained solution by using Inductively Coupled Plasma-Atomic Emission Spectrometry (ICP-AES).

The tensile strength (TS) of the steel sheet according to the present embodiment is 500 MPa or more. Further, the tensile strength may be in a range of 500 to 750 MPa. By setting the tensile strength to 500 MPa or more, it is possible to suitably apply the steel sheet according to the present embodiment to panel system components such as a door outer. The tensile strength is preferably 550 MPa or more or 600 MPa or more.

Further, by setting the tensile strength to 750 MPa or less, it is possible to suppress deterioration in external appearance after press forming. The tensile strength is preferably 700 MPa or less.

The tensile strength is evaluated in accordance with JIS Z 2241:2011. A test piece is a No. 5 test piece of JIS Z 2241:2011. A tensile test piece is taken from a position of a ¼ portion from an end portion in the sheet width direction, and a longitudinal direction thereof is a direction perpendicular to the rolling direction.

The sheet thickness of the steel sheet according to the present embodiment is not limited to a specific range, and is preferably in a range of 0.2 to 2.0 mm in consideration of versatility or manufacturability. By setting the sheet thickness to 0.2 mm or more, it becomes easier to keep the steel sheet shape flat, and dimensional accuracy and shape accuracy can be improved. Therefore, the sheet thickness is preferably 0.2 mm or more. More preferably, the sheet thickness is 0.4 mm or more.

On the other hand, when the sheet thickness is 2.0 mm or less, it becomes easier to perform appropriate strain application and temperature control in the manufacturing process, and a homogeneous structure can be obtained. Therefore, the sheet thickness is preferably 2.0 mm or less. More preferably, the sheet thickness is 1.5 mm or less.

Next, the press-formed article according to the present embodiment, which can be manufactured by press-forming the steel sheet described above, will be described. The press-formed article according to the present embodiment has the same chemical composition as that of the steel sheet described above. Further, the press-formed article according to the present embodiment may have the above-described plating layer on at least one surface thereof. The C concentration gradient in the decarburized layer does not change even after press forming, and therefore, in the press-formed article according to the present embodiment, ΔC that is calculated from $C_{20}$, which is the C content at a 20 μm depth position from the surface, $C_{60}$, which is the C content at a 60 μm depth position from the surface, and the following expression (1) is in a range of 0.20 to 0.90 mass %/mm.

$$\Delta C = (C_{60} - C_{20})/(0.04) \quad (1)$$

The C concentration gradient is set to preferably 0.30 mass %/mm or more, 0.35 mass %/mm or more, 0.40 mass %/mm or more, or 0.45 mass %/mm or more, and preferably 0.80 mass %/mm or less or 0.75 mass %/mm or less. The ΔC of the press-formed article is obtained by the same method as that of the steel sheet.

Since the press-formed article according to the present embodiment is obtained by press-forming the steel sheet described above, the occurrence of ghost lines is suppressed and the external appearance quality is excellent. The external appearance quality being excellent means that striped patterns (that is, ghost lines) occurring on the surface at intervals on the order of several millimeters are not observed. Further, in other words, the maximum length of each of the stripe patterns occurring at intervals on the order of several millimeters, which are confirmed when an optional region having a size of 100 mm×100 mm is visually confirmed, is 50 mm or less. The maximum length of the stripe pattern is preferably 20 mm or less. Further, it is more preferable that no stripe pattern is observed.

As a specific example of the press-formed article, for example, a panel system component such as a door outer for a vehicle body can be given.

Next, a method for manufacturing the steel sheet according to the present embodiment will be described.

In the steel sheet according to the present embodiment, the effect thereof can be obtained as long as it has the above characteristics, regardless of a manufacturing method. However, by using the steel having the chemical composition described above and performing annealing under the following conditions after hot rolling and cold rolling, it is possible to stably manufacture a steel sheet in which ΔC (C concentration gradient) is preferably controlled.

(Annealing after Hot Rolling)

First, a hot-rolled steel sheet is obtained by performing hot rolling on a slab having the chemical composition described above under general conditions. Primary annealing is performed on the obtained hot-rolled steel sheet in a high temperature range in atmospheric atmosphere. This primary annealing is performed under conditions of an annealing temperature in a range of 550 to 700° C. and an annealing time of 2 hours or longer. By performing annealing in a high-temperature range after the hot rolling, internal oxides of Si and Mn are formed in the surface layer of the steel sheet. As a result, surface concentration of Si and Mn is suppressed in annealing after cold rolling, and decarburization is promoted. In this way, ΔC can be preferably controlled.

When the annealing temperature is lower than 550° C. or the annealing time is shorter than 2 hours, the ΔC of the steel sheet cannot be controlled preferably.

After the annealing is performed, a steel sheet or a steel strip having a desired thickness is manufactured by performing pickling treatment and cold rolling with a cumulative rolling reduction of 70% or more. By setting the cumulative rolling reduction of the cold rolling to 70% or more, austenite recrystallization is promoted during annealing after cold rolling, and an increase in austenite fraction can be suppressed. As a result, a ferrite fraction, which has a large C diffusion coefficient, increases during annealing after cold rolling, and decarburization is promoted.

The cumulative rolling reduction as referred to herein is expressed by {1−(sheet thickness after cold rolling/sheet thickness before cold rolling)}×100(%).

After the cold rolling, secondary annealing is performed to obtain a steel sheet having desired mechanical properties. At that time, for example, by setting a dew point during the secondary annealing (average dew point in an annealing furnace) to −10° C. or higher and setting a stay time of the steel sheet in a temperature range of 700° C. or higher to be in a range of 50 to 400 seconds, it is possible to stably decarburize the surface of the steel sheet. Although an upper limit of the dew point does not need to be specified, it may be set to about 10° C. In a case where the dew point is too low or a case where the stay time is too short, decarburization does not proceed sufficiently, and ΔC cannot be controlled preferably. Further, in a case where the stay time is too long, there is a case where sufficient tensile strength is not obtained. The temperature during the annealing is, for example, in a range of about 750 to 850° C.

Conditions other than the conditions described above are not particularly limited. However, it is preferable to satisfy, for example, the following conditions.

After a slab is heated to a temperature range of 1100° C. or higher, it is hot-rolled. After the hot rolling, coiling is performed, primary annealing is performed, and then pickling is performed. A finish rolling temperature of the hot rolling is preferably 900° C. or higher, and a coiling temperature is preferably 650° C. or lower. After the pickling, cold rolling is performed. Secondary annealing may be performed after the cold rolling, and then the above-described plating layer may be formed as necessary.

Next, a method for manufacturing the press-formed article according to the present embodiment will be described.

As the press forming method, cold working is preferable in order to maintain the obtained structure and suppress the occurrence of ghost lines. The cold working method is not particularly limited as long as a steel sheet can be formed by relatively moving a die and a punch.

EXAMPLES

Next, examples of the present invention will be described. However, conditions in the examples are examples of conditions that are adopted to confirm the feasibility and effect of the present invention. The present invention is not limited to these condition examples. The present invention can adopt various conditions as long as the object of the present invention is achieved without departing from the gist of the present invention.

Steel having the chemical composition shown in Table 1 was melted, and a slab with a thickness in a range of 240 to 300 mm was manufactured by continuous casting. After the obtained slab is heated to a temperature range of 1100° C. or higher, hot rolling was performed. After the hot rolling, coiling was performed, primary annealing was performed under the conditions shown in Table 2, and then pickling was performed. A finish rolling temperature of the hot rolling was set to 900° C. or higher, and a coiling temperature was set to 650° C. or lower. After the pickling, cold rolling with a cumulative rolling reduction in a range of 70 to 90% was performed. After the cold rolling, secondary annealing was performed under the conditions shown in Table 2, and as necessary, a hot-dip galvannealed layer (GA), a hot-dip galvanized layer (GI), and an electrogalvanized layer (EG) are formed. The steel sheets and plated steel sheets shown in Table 2 were obtained by the above method. The sheet thickness of each of the obtained steel sheet and plated steel sheet was in a range of 0.2 to 2.0 mm.

After annealing after the cold rolling was performed, substantially semi-cylindrical simulated components (press-formed articles) simulating a door outer were manufactured by press forming by using the steel sheet and the plated steel sheet. When press-forming the simulated component, a material (steel sheet or plated steel sheet) was actively put into a die, and at any position on the surface of the simulated component, the ratio of strain in a direction perpendicular to the direction along the surface of the simulated component (any direction) to strain in any direction along the surface of the simulated component was set to about 1. That is, the press forming was performed such that the anisotropy of strain did not occur at any position on the surface of the simulated component.

With respect to the obtained steel sheet, the plated steel sheet, and the simulated component (press-formed article), ΔC was obtained by the method described above. Since the ΔC of the steel sheet and the plated steel sheet and the ΔC of the simulated component were the same value, the ΔC of the simulated component is not shown in the table.

Further, the tensile strength of the steel sheet and the external appearance quality of the simulated component were evaluated by the following methods. Since there is no significant difference between the tensile strength of the steel sheet and the tensile strength of the simulated component (press-formed article), whether or not the steel sheet had a desired tensile strength as the simulated component was evaluated.

Tensile Strength

The tensile strength was evaluated in accordance with JIS Z 2241:2011. A test piece was a No. 5 test piece of JIS Z 2241:2011. A tensile test piece was taken from a position of a ¼ portion from an end portion in the sheet width direction, and a longitudinal direction thereof was a direction perpendicular to the rolling direction. In a case where the obtained tensile strength was 500 MPa or more, it was determined to be high strength and acceptable. On the other hand, in a case where the obtained tensile strength was less than 500 MPa, it was determined to be unacceptable because the strength was inferior.

External Appearance Quality

The external appearance quality was evaluated by the degree of ghost lines occurring on the surface of the simulated component after forming. The surface after press forming was ground with a grindstone, striped patterns at intervals on the order of several millimeters, which occurred on the surface, were determined to be ghost lines, and scores of 1 to 5 were given according to the degree of the occurrence of the stripe patterns. Any region having a size of 100 mm×100 mm was visually confirmed, and a case where no stripe pattern was confirmed was rated as "1", a case where the maximum length of the stripe pattern was 20 mm or less was rated as "2", a case where the maximum length of the stripe pattern exceeds 20 mm and 50 mm or less was rated as "3", a case where the maximum length of the stripe pattern exceeds 50 mm and 70 mm or less was rated as "4", and a case where the maximum length of the stripe pattern exceeds 70 mm was rated as "5". In a case where the evaluation was "3" or lower, it was determined to be excellent in external appearance quality and acceptable. On the other hand, in a case where the evaluation was "4" or higher, it was determined to be unacceptable because the external appearance quality was inferior.

TABLE 1

| | Chemical composition (mass %) Remainder: Fe and impurities | | | | | | | | | | | | | |
|---|---|---|---|---|---|---|---|---|---|---|---|---|---|---|
| Steel | C | Mn | Si | Al | P | S | N | O | Cr | Mo | Ti | B | Other | Remarks |
| A | 0.082 | 2.05 | 0.450 | 0.035 | 0.020 | 0.0054 | 0.0035 | 0.0009 | | | | | | Present invention steel |
| B | 0.098 | 1.30 | 0.013 | 0.298 | 0.015 | 0.0014 | 0.0038 | 0.0013 | 0.40 | 0.10 | 0.010 | 0.0015 | | Present invention steel |
| C | 0.060 | 1.78 | 0.044 | 0.302 | 0.047 | 0.0012 | 0.0045 | 0.0010 | 0.40 | 0.07 | 0.011 | 0.0018 | | Present invention steel |
| D | 0.100 | 1.28 | 0.011 | 0.300 | 0.021 | 0.0019 | 0.0035 | 0.0019 | 0.39 | 0.10 | | | | Present invention steel |
| E | 0.115 | 1.30 | 0.056 | 0.293 | 0.020 | 0.0020 | 0.0039 | 0.0015 | 0.41 | 0.10 | | | | Comparative steel |
| F | 0.030 | 1.82 | 0.423 | 0.054 | 0.020 | 0.0020 | 0.0035 | 0.0009 | | | | | | Comparative steel |
| G | 0.063 | 2.45 | 0.020 | 0.042 | 0.018 | 0.0010 | 0.0038 | 0.0001 | | | 0.015 | 0.0019 | | Comparative steel |
| H | 0.080 | 2.02 | 0.411 | 0.050 | 0.020 | 0.0020 | 0.0031 | 0.0009 | | | | | Nb: 0.005, Sb: 0.005 | Present invention steel |
| I | 0.078 | 2.01 | 0.448 | 0.033 | 0.035 | 0.0034 | 0.0044 | 0.0012 | | | | | V: 0.02, REM: 0.0017 | Present invention steel |
| J | 0.077 | 2.00 | 0.430 | 0.050 | 0.018 | 0.0024 | 0.0046 | 0.0009 | | | | | W: 0.03, Cu: 0.05 | Present invention steel |
| K | 0.095 | 1.30 | 0.032 | 0.300 | 0.017 | 0.0020 | 0.0033 | 0.0024 | 0.40 | 0.11 | | | Ni: 0.05, Sn: 0.01 | Present invention steel |
| L | 0.100 | 1.30 | 0.015 | 0.302 | 0.024 | 0.0018 | 0.0035 | 0.0019 | 0.40 | 0.10 | | | Zr: 0.001, REM: 0.0021 | Present invention steel |
| M | 0.101 | 1.30 | 0.013 | 0.299 | 0.011 | 0.0041 | 0.0039 | 0.0018 | 0.50 | 0.10 | | | Mg: 0.0019 | Present invention steel |
| N | 0.099 | 1.30 | 0.021 | 0.288 | 0.020 | 0.0080 | 0.0040 | 0.0019 | 0.70 | 0.10 | | | Ca: 0.0016, REM: 0.0014 | Present invention steel |

The underline indicates that the value falls outside the range of the present invention.

TABLE 2

| | | Primary annealing condition | | Secondary annealing condition | | | Steel sheet | | | Press-formed article | |
|---|---|---|---|---|---|---|---|---|---|---|---|
| No. | Steel | Annealing temperature (° C.) | Annealing time (h) | Annealing temperature (° C.) | Dew point (° C.) | Stay time at temperature range of 700° C. or higher (sec) | Plating type | ΔC (mass %/mm) | Tensile strength (MPa) | External appearance evaluation | Remarks |
| 1 | A | 650 | 6 | 780 | −5 | 210 | GA | 0.68 | 620 | 3 | Present invention example |
| 2 | A | 650 | 6 | 783 | −4 | 102 | GA | 0.45 | 640 | 3 | Present invention example |
| 3 | A | 640 | 5 | 811 | −30 | 210 | GA | 0.09 | 648 | 5 | Comparative example |
| 4 | A | 680 | 9 | 806 | −3 | 32 | GA | 0.08 | 650 | 5 | Comparative example |
| 5 | A | 510 | 6 | 791 | −3 | 120 | GA | 0.18 | 632 | 4 | Comparative example |
| 6 | B | 630 | 8 | 800 | −5 | 155 | Without | 0.85 | 618 | 3 | Present invention example |
| 7 | C | 620 | 6 | 783 | −1 | 210 | GA | 0.55 | 601 | 1 | Present invention example |
| 8 | C | 620 | 6 | 811 | −3 | 302 | GA | 0.57 | 579 | 2 | Present invention example |
| 9 | C | 560 | 2 | 795 | −8 | 145 | GA | 0.24 | 593 | 2 | Present invention example |
| 10 | C | 560 | 1 | 797 | −2 | 165 | GA | 0.17 | 605 | 4 | Comparative example |
| 11 | C | 600 | 3 | 800 | −14 | 100 | GA | 0.18 | 592 | 4 | Comparative example |

TABLE 2-continued

| | | Primary annealing condition | | Secondary annealing condition | | | Steel sheet | | | Press-formed article | |
|---|---|---|---|---|---|---|---|---|---|---|---|
| No. | Steel | Annealing temperature (° C.) | Annealing time (h) | Annealing temperature (° C.) | Dew point (° C.) | Stay time at temperature range of 700° C. or higher (sec) | Plating type | ΔC (mass %/mm) | Tensile strength (MPa) | External appearance evaluation | Remarks |
| 12 | C | 620 | 6 | 809 | −5 | 45 | GA | 0.12 | 595 | 5 | Comparative example |
| 13 | D | 660 | 5 | 815 | −3 | 135 | EG | 0.88 | 598 | 3 | Present invention example |
| 14 | E | 650 | 6 | 783 | −5 | 210 | Without | 1.12 | 618 | 4 | Comparative example |
| 15 | F | 650 | 6 | 795 | −1 | 187 | GA | 0.25 | 488 | 3 | Comparative example |
| 16 | G | 650 | 6 | 800 | −4 | 195 | GA | 0.44 | 689 | 5 | Comparative example |
| 17 | H | 640 | 7 | 785 | −4 | 200 | GI | 0.61 | 635 | 3 | Present invention example |
| 18 | I | 650 | 6 | 790 | −5 | 184 | GA | 0.52 | 625 | 2 | Present invention example |
| 19 | J | 630 | 5 | 785 | −6 | 154 | Without | 0.55 | 641 | 1 | Present invention example |
| 20 | K | 660 | 5 | 800 | −5 | 195 | GA | 0.58 | 615 | 2 | Present invention example |
| 21 | L | 620 | 6 | 798 | −3 | 254 | GI | 0.85 | 576 | 3 | Present invention example |
| 22 | L | 610 | 4 | 810 | 0 | 485 | GI | 0.98 | 531 | 4 | Comparative example |
| 23 | M | 680 | 5 | 805 | −5 | 168 | GA | 0.55 | 608 | 3 | Present invention example |
| 24 | N | 650 | 6 | 800 | −4 | 200 | GA | 0.69 | 630 | 2 | Present invention example |
| 25 | N | — | — | 820 | −9 | 169 | GA | 0.18 | 668 | 4 | Comparative example |

The underline indicates that the value falls outside the range of the present invention and that the characteristic is not preferable.

From Table 2, it can be seen that the press-formed articles according to the present invention examples have high strength and excellent external appearance quality. Further, it can be seen that the steel sheets according to the present invention examples can manufacture press-formed articles having high strength and excellent external appearance quality.

On the other hand, it can be seen that the press-formed articles according to the comparative examples are inferior in strength or have deteriorated external appearance quality. Further, it can be seen that the steel sheets according to the comparative examples cannot manufacture press-formed articles having high strength and excellent external appearance quality.

INDUSTRIAL APPLICABILITY

According to the above aspects of the present invention, it is possible to provide a press-formed article having high strength and excellent external appearance quality, and a steel sheet which can manufacture of the press-formed article.

What is claimed is:

1. A steel sheet consisting of, as a chemical composition, by mass %:

C: 0.040% to 0.105%;
Mn: 1.00% to 2.30%;
Si: 0.005% to 1.500%;
Al: 0.005% to 0.700%;
P: 0.100% or less;
S: 0.0200% or less;
N: 0.0150% or less;
O: 0.0100% or less;
Cr: 0% to 0.80%;
Mo: 0% to 0.16%;
Ti: 0% to 0.100%;
B: 0% to 0.0100%;
Nb: 0% to 0.060%;
V: 0% to 0.50%;
Ni: 0% to 1.00%;
Cu: 0% to 1.00%;
W: 0% to 1.00%;
Sn: 0% to 1.00%;
Sb: 0% to 0.200%;
Ca: 0% to 0.0100%;
Mg: 0% to 0.0100%;
Zr: 0% to 0.0100%;
REM: 0% to 0.0100%; and
a remainder: Fe and impurities, wherein ΔC that is calculated from $C_{20}$, which is a C content, in mass %, at a 20 μm depth position from a surface, $C_{60}$, which is a C content, in mass %, at a 60 μm depth position from the surface, and the following expression (1) is in a range of 0.20 to 0.90 mass %/mm, and a tensile strength is 500 MPa or more, $$\Delta C = (C_{60} - C_{20})/(0.04). \quad (1)$$

2. The steel sheet according to claim 1, further comprising, as the chemical composition, by mass %, one or more of:

Cr: 0.01% to 0.80%;
Mo: 0.01% to 0.16%;

Ti: 0.001% to 0.100%;
B: 0.0001% to 0.0100%;
Nb: 0.001% to 0.060%;
V: 0.01% to 0.50%;
Ni: 0.01% to 1.00%;
Cu: 0.01% to 1.00%;
W: 0.01% to 1.00%;
Sn: 0.01% to 1.00%;
Sb: 0.001% to 0.200%;
Ca: 0.0001% to 0.0100%;
Mg: 0.0001% to 0.0100%;
Zr: 0.0001% to 0.0100%; and
REM: 0.0001% to 0.0100%.

3. The steel sheet according to claim 1, further comprising, as the chemical composition, by mass %, C: 0.040% to 0.080%.

4. The steel sheet according to claim 1, wherein the ΔC is in a range of 0.30 to 0.80 mass %/mm.

5. The steel sheet according to claim 1, wherein at least one surface of the steel sheet has a plating layer.

6. The steel sheet according to claim 1, wherein the tensile strength is in a range of 500 to 750 MPa.

7. A press-formed article that is obtained by press-forming the steel sheet according to claim 1, wherein ΔC that is calculated from $C_{20}$, which is a C content, in mass %, at a 20 μm depth position from a surface, $C_{60}$, which is a C content, in mass %, at a 60 μm depth position from the surface, and the following expression (1) is in a range of 0.20 to 0.90 mass %/mm, $$\Delta C = (C_{60} - C_{20})/(0.04\ \text{mm}) \quad (1)$$

8. A steel sheet comprising, as a chemical composition, by mass %:

C: 0.040% to 0.105%;
Mn: 1.00% to 2.30%;
Si: 0.005% to 1.500%;
Al: 0.005% to 0.700%;
P: 0.100% or less;
S: 0.0200% or less;
N: 0.0150% or less;
O: 0.0100% or less;
Cr: 0% to 0.80%;
Mo: 0% to 0.16%;
Ti: 0% to 0.100%;
B: 0% to 0.0100%;
Nb: 0% to 0.060%;
V: 0% to 0.50%;
Ni: 0% to 1.00%;
Cu: 0% to 1.00%;
W: 0% to 1.00%;
Sn: 0% to 1.00%;
Sb: 0% to 0.200%;
Ca: 0% to 0.0100%;
Mg: 0% to 0.0100%;
Zr: 0% to 0.0100%;
REM: 0% to 0.0100%; and
a remainder: Fe and impurities, wherein ΔC that is calculated from $C_{20}$, which is a C content, in mass %, at a 20 μm depth position from a surface, $C_{60}$, which is a C content, in mass %, at a 60 μm depth position from the surface, and the following expression (1) is in a range of 0.20 to 0.90 mass %/mm, and a tensile strength is 500 MPa or more, $$\Delta C = (C_{60} - C_{20})/(0.04). \quad (1)$$

* * * * *